US011242623B2

(12) United States Patent
Erdmann et al.

(10) Patent No.: US 11,242,623 B2
(45) Date of Patent: Feb. 8, 2022

(54) CONTINUOUS METHOD FOR PRODUCING A THERMALLY STABILIZED MULTIFILAMENT THREAD, MULTIFILAMENT THREAD, AND FIBER

(71) Applicant: FRAUNHOFER-GESELLSCHAFT ZUR FÖRDERUNG DER ANGEWANDTEN FORSCHUNG E. V., Munich (DE)

(72) Inventors: Jens Erdmann, Nuthetal OT Saarmund (DE); Johannes Ganster, Potsdam (DE)

(73) Assignee: Fraunhofer-Gesellschaft zur förderung der angewandten Forschung e.V., Munich (DE)

( * ) Notice: Subject to any disclaimer, the term of this patent is extended or adjusted under 35 U.S.C. 154(b) by 217 days.

(21) Appl. No.: 16/476,739

(22) PCT Filed: Jan. 10, 2017

(86) PCT No.: PCT/EP2017/050404
§ 371 (c)(1),
(2) Date: Jul. 9, 2019

(87) PCT Pub. No.: WO2018/130268
PCT Pub. Date: Jul. 19, 2018

(65) Prior Publication Data
US 2019/0360126 A1 Nov. 28, 2019

(51) Int. Cl.
*D01D 1/04* (2006.01)
*D01D 5/12* (2006.01)
(Continued)

(52) U.S. Cl.
CPC ..... *D01F 9/225* (2013.01); *D01D 5/08* (2013.01); *D01F 6/38* (2013.01); *D02J 1/22* (2013.01);
(Continued)

(58) Field of Classification Search
CPC .... B29C 2035/0877; D01D 1/04; D01D 5/08; D01D 5/12; D01D 5/16; D01F 6/38;
(Continued)

(56) References Cited

U.S. PATENT DOCUMENTS 3,961,888 A * 6/1976 Riggs ..... D01F 9/22 8/115.54
4,295,844 A * 10/1981 Warner ..... D06M 13/325 423/447.4
(Continued)

FOREIGN PATENT DOCUMENTS

CN 101586265 A 11/2009
CN 101693769 A 4/2010
(Continued)

OTHER PUBLICATIONS

Translation of DE 2603029 A (published on Aug. 4, 1977).*
(Continued)

*Primary Examiner* — Leo B Tentoni
(74) *Attorney, Agent, or Firm* — Leydig, Voit & Mayer, Ltd.

(57) ABSTRACT

The invention relates to a method for thermally stabilizing melt-spun PAN precursors. For this purpose, the invention provides a continuous method for producing a thermally stabilized multifilament thread made of a meltable copolymer of polyacrylonitrile (PAN), wherein a pre-stabilized multifilament thread is thermally stabilized and in the process at least temporarily stretched. The invention additionally relates to a thermally stabilized multifilament thread
(Continued)

which can be obtained according to a corresponding method and to a carbon fiber which is made of the correspondingly thermally stabilized multifilament thread.

17 Claims, 2 Drawing Sheets

(51) Int. Cl.

| | |
|---|---|
| ***D01D 5/16*** | (2006.01) |
| ***D01F 9/22*** | (2006.01) |
| ***D06M 11/38*** | (2006.01) |
| ***D06M 13/248*** | (2006.01) |
| ***D06M 13/405*** | (2006.01) |
| ***D06M 13/418*** | (2006.01) |
| ***D01F 6/38*** | (2006.01) |
| ***D02J 1/22*** | (2006.01) |
| ***D02J 13/00*** | (2006.01) |
| ***D01D 5/08*** | (2006.01) |
| ***D06M 10/00*** | (2006.01) |

(52) U.S. Cl.
CPC ..... *D02J 1/228* (2013.01); *D02J 13/00* (2013.01); *D06M 10/008* (2013.01)

(58) Field of Classification Search
CPC .... D01F 9/22; D01F 9/225; D02J 1/22; D02J 1/228; D02J 13/00; D06M 10/008; D06M 11/38; D06M 13/248; D06M 13/405; D06M 13/418
USPC ..... 264/29.2, 29.6, 210.5, 210.7, 210.8, 264/211.14, 211.15, 211.17, 289.3, 290.5, 264/290.7, 331.18, 331.19, 485; 8/115.52, 115.54, 115.55, 115.62, 115.65, 8/115.69; 19/66 R; 423/447.2, 447.4, 423/447.6, 447.7
See application file for complete search history.

(56) References Cited

U.S. PATENT DOCUMENTS

| | | | | |
|---|---|---|---|---|
| 4,661,336 | A * | 4/1987 | McCabe | D01F 9/225 264/29.2 |
| 6,103,211 | A * | 8/2000 | Matsuhisa | D01F 9/22 423/447.8 |
| 8,236,273 | B2 | 8/2012 | Oyama et al. | |
| 2010/0260658 | A1 | 10/2010 | Oyama et al. | |
| 2017/0275405 | A1 | 9/2017 | Hahn et al. | |
| 2017/0298539 | A1 | 10/2017 | Hahn et al. | |

FOREIGN PATENT DOCUMENTS

| | | | | | |
|---|---|---|---|---|---|
| CN | 102953151 | A | | 3/2013 | |
| DE | 2603029 | A | * | 8/1977 | D01F 9/225 |
| DE | 102015222585 | A1 | | 5/2017 | |
| EP | 0 066 389 | A2 | | 12/1982 | |
| JP | 2007-186802 | A | | 7/2007 | |
| WO | WO 2009/084390 | A1 | | 7/2009 | |
| WO | WO 2016/050478 | A1 | | 4/2016 | |
| WO | WO 2016/050479 | A1 | | 4/2016 | |

OTHER PUBLICATIONS

Japan Patent Office, Notice of Reasons for Refusal in Japanese Patent Application No. 2019-536989 (dated Oct. 6, 2020).
Bahl et al., "Manufacture of Carbon Fibers," Chapter 1, Carbon Fibers, 3rd edition Revised and Expanded, edited by Jean-Baptiste Donner et al., Marcel Dekker, Inc., New York, pp. 1-27 (1998).
European Patent Office, International Search Report in International Application No. PCT/EP2017/050404 (dated Oct. 17, 2017).
European Patent Office, Written Opinion in International Application No. PCT/EP2017/050404 (dated Oct. 17, 2017).
International Bureau of WIPO, International Preliminary Report on Patentability in International Application No. PCT/EP2017/050404 (dated Jul. 16, 2019).
Japan Patent Office, Notice of Reasons for Refusal in Japanese Patent Application No. 2019-536989 (dated Sep. 28, 2021).

* cited by examiner

CONTINUOUS METHOD FOR PRODUCING A THERMALLY STABILIZED MULTIFILAMENT THREAD, MULTIFILAMENT THREAD, AND FIBER

CROSS-REFERENCE TO A RELATED APPLICATION

This patent application is the U.S. national phase of International Application No. PCT/EP2017/050404, filed on Jan. 10, 2017, the disclosure of which is incorporated herein by reference in its entirety for all purposes.

The present invention relates to a method for thermal stabilisation of meltspun PAN precursors. For this purpose, the invention provides a continuous method for the production of a thermally stabilised multifilament yarn made of a meltable copolymer of polyacrylonitrile (PAN), in which a prestabilised multifilament yarn is thermally stabilised and is hereby stretched at least at times. The present invention relates in addition to a thermally stabilised multifilament yarn which is obtainable according to a corresponding method, and also to a carbon fibre which was formed from the correspondingly thermally stabilised multifilament yarn.

At present, polyacrylonitrile (PAN) or copolymers of polyacrylonitrile are the dominant polymers (>95%) as starting material for the production of precursor multifilament yarns and carbon fibres produced therefrom. The large band width of ex-PAN carbon fibres is completed by the ultrahigh-modulus pitch-based carbon fibres. An overview of production capacities, of the chemical and physical structure and also of the mechanical properties and also applications of such carbon fibres is given in J. P. Donnet et al., Carbon fibers, third edition, Marcel Dekker, Inc. New York, Basle, Hong Kong.

PAN or PAN copolymer precursor fibres have been produced commercially to date exclusively via wet- or dry-spinning methods. For this purpose, a solution of the polymers with concentrations ≤20% is spun either in a coagulation bath or in a hot steam atmosphere, the solvent diffusing out of the fibre. In this way, qualitatively high-value precursors are produced. From the solvents and the treatment thereof required on the one hand, and, on the other hand, from the relatively low throughput of solution spinning methods, there results the comparatively high production costs for PAN precursors which amount to approx. 50% of the costs of the final carbon fibre.

Efforts have been made for several decades to reduce significantly the costs for production of carbon fibres and consequently to be able to open up new fields of application. In this context, one solution approach is to develop alternative cheaper precursor materials or precursor production methods and to coordinate the subsequent process steps of fibre spinning and stabilisation/carbonisation thereto.

The approach of making PAN available for processing by means of meltspinning, in order hence to reduce significantly the production costs of the PAN precursor, is promising.

There should thereby be differentiated in principle approaches via external plasticisation (mixture of the polymer with additives) and via internal plasticisation (copolymerisation). In both cases, the interaction of the nitrile groups is thereby disturbed so that melting is effected below the decomposition temperature of the polymer.

In principle, the object of internal plasticisation is achieved by a copolymer composition which is disclosed in PCT/EP2015/070769 and which can be produced according to the method described in DE 10 2015 222 585.2.

The resulting meltable and spinnable copolymer consists of acrylonitrile with at least one alkoxyalkylacrylate and/or an alkylacrylate and/or a vinyl ester, the polymerisation reaction being initiated radically and the released heat flow increasing constantly, at least at times, over the entire period of time of metering of a radically polymerisable comonomer, however never decreasing.

Since the thus obtained meltable PAN copolymers and also the precursors meltspun therefrom (endless multifilament yarns) are new, a solution path for their "thermal stabilisation" is known or described neither in the patent literature nor in the scientific literature.

It is hence the object of the invention, starting from the state of the art, to indicate a method with which further stabilisation of the PAN precursor fibre is achieved so that a reliable further processing of the precursor fibres is possible. In addition, the object of the present invention is to indicate correspondingly stabilised PAN precursor fibres and also carbon fibres obtainable herefrom.

This object is achieved by the method for the production of a thermally stabilised multifilament yarn disclosed herein. A multifilament yarn produced corresponding to the method according to the invention is also indicated. Further disclosed is a fibre formed from the multifilament yarn according to the invention by further temperature treatment.

DETAILED DESCRIPTION OF THE INVENTION

Figure 1:
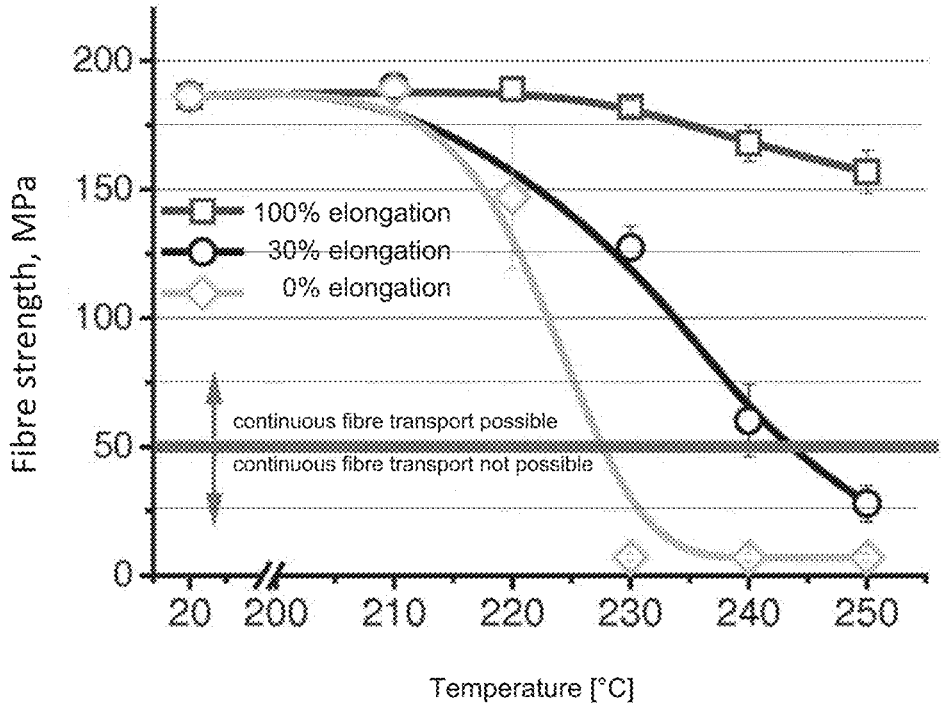
FIG. 1 illustrates the mechanical strength of the thermally stabilised PAN precursor fibres in accordance with an embodiment of the invention as a function of the applied temperature.

The present invention hence relates to a continuous method for the production of a thermally stabilised multifilament yarn made of a meltable copolymer of polyacrylonitrile (PAN), in which prestabilised multifilament yarn or a non-prestabilised multifilament yarn is fed continuously, in the case of a non-prestabilised multifilament yarn, a prestabilisation and subsequently a neutralisation is implemented and subsequently the prestabilised multifilament yarn is thermally stabilised at temperatures of more than 0° C., stretching of the multifilament yarn is implemented, at least at times, during, before and/or after the thermal stabilisation.

There is understood by the term "prestabilised multifilament yarn" according to the invention, a multifilament yarn in which the originally meltable copolymers of polyacrylonitrile (PAN) have been converted into an unmeltable state by a suitable method. During heating, the spatial form of the multifilament yarn is hence maintained.

Surprisingly, it was able to be established that, when implementing stretching, in particular during thermal stabilisation of the prestabilised multifilament yarn, a significant increase in mechanical strength of the correspondingly thermally stabilised fibres is obtained and tearing of the fibres can be prevented during the method. As a result of the increased strength, it can be ensured that the method can be implemented without interruptions.

A preferred embodiment provides that the strength of the thermally stabilised multifilament yarn standardised to the filament diameter is at least 50 MPa, preferably at least 75 MPa, further preferably at least 100 MPa, in particular at least 125 MPa.

Furthermore, it is advantageous if the multifilament yarn is stretched by 10 to 300%, particularly preferably by 20 and 200%, particularly preferably by 25 to 150%, in particular by 50 to 110%. Stretching by e.g. 10% thereby means that the length of the multifilament yarn, after stretching, is greater by 10% than before the stretching process etc.

The thermal stabilisation can be implemented, at least at times, at temperatures of 50 to 400° C., preferably 80 to 300° C., particularly preferably of 90 to 270° C., in particular 180 to 260° C.

In addition, it is advantageous if the thermal stabilisation is effected by feeding the multifilament yarn through at least one oven or at least two ovens connected one after the other.

Particularly preferably, the thermal stabilisation is implemented in two stages, the multifilament yarn not being stretched or to a lower degree in the first stage than in the second stage and/or being stabilised, in the first stage, at lower temperatures on average than in the second stage. The two-stage thermal stabilisation is thereby implemented particularly preferably in at least two separate ovens.

The thermal stabilisation can thereby be implemented such that rising or constant temperatures prevail in the feeding direction of the multifilament yarn.

In particular, the thermal stabilisation is implemented such that a stabilisation degree (DOS) of the copolymer of polyacrylonitrile of 20 to 75%, preferably of 25 to 60%, particularly preferably of 30 to 50%, in particular 30 to 47%, results.

The thermal stabilisation can likewise be implemented in an oxidising atmosphere, preferably in an oxygen-comprising atmosphere, in particular air.

In a particularly preferred embodiment, the thermal stabilisation is implemented by feeding the multifilament yarn through at least two ovens which are connected subsequently. It is hereby preferred if, in at least a first oven, no stretching or stretching <10% and, in at least one further oven, stretching of at least 30%, preferably of at least 50%, is effected.

Alternatively, or in addition hereto, it is likewise advantageous if, in at least a first oven, temperatures of 80 to 200° C. are set, preferably in the form of a rising temperature gradient and, in at least one further oven, temperatures of 130 to 270° C., preferably in the form of a rising temperature gradient are set. The stabilisation is hereby implemented preferably such that, after exit of the thermally stabilised multifilament yarn from the last oven, a stabilisation degree (DOS) of the copolymer of polyacrylonitrile of 25 to 60%, particularly preferably of 30 to 50%, in particular 30 to 47%, results and/or a strength of the thermally stabilised multifilament yarn of at least 50 MPa, preferably at least 75 MPa, further preferably at least 100 MPa, in particular at least 125 MPa, results.

Preferably, the thermal stabilisation is effected with application of tensile stress to the multifilament. The tensile stress thereby serves for stretching the multifilament yarn. Preferably, the tensile stress is hereby from 0.1 to 10 cN/tex, further preferably from 0.5 to 5 cN/tex, particularly preferably from 1 to 3 cN/tex.

In particular, the thermal stabilisation is implemented over a period of time of 10 to 180 min, preferably 20 to 100 min, particularly preferably 30 to 60 min.

In the case of the method according to the invention, in particular the subsequent copolymers of polyacrylonitrile are possible:

Copolymers of polyacrylonitrile (PAN), producible by copolymerisation of 99.9 to 70% by mol, preferably 97 to 80% by mol, particularly preferably 95 to 85% by mol, of acrylonitrile with at least one comonomer selected from a) 0.1 to 20% by mol, preferably 3 to 15% by mol, particularly preferably 3 to 10% by mol, of at least one alkoxyalkylacrylate of the general formula I, Formula I

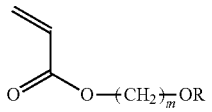

with R=$C_nH_{2n+1}$ and n=1-8 and m=1-8, in particular n=1-4 and m=1-4 b) 0 to 10% by mol, preferably 1 to 5% by mol, of at least one alkylacrylate of the general formula II Formula II

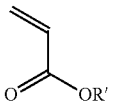

with R'=$C_nH_{2n+1}$ and n=1-18, and c) 0 to 10% by mol, preferably 1 to 5% by mol, of at least one vinyl ester of the general formula III Formula III

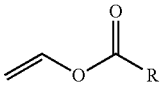

with R=$C_nH_{2n+1}$ and n=1-18.

The multifilament yarn is produced advantageously by melting and extrusion of the copolymer of polyacrylonitrile through at least one spinning nozzle and spinning to form multifilaments.

The prestabilisation of the multifilament yarn can be effected either in a separate step preceding the method according to the invention. Likewise the prestabilisation can be effected in situ during the method according to the invention, so that for example spinning of a melt of the PAN copolymer to form the multifilament yarn, prestabilisation and also directly subsequently a further stabilisation according to the method according to the invention can be effected.

In particular, the prestabilisation of the non-prestabilised multifilament yarn is thereby implemented as follows:

i) by treatment with a mixture comprising at least one solvent for polyacrylonitrile and an aqueous alkaline solution or consisting hereof, the mixture comprising preferably from 0.1 to 60% by volume of the solvent and from 40 to 99.9% by volume of the aqueous alkaline solution or consisting hereof, the solvent being selected in particular from the group consisting of dimethylsulphoxide, dimethylformamide, dimethylacetamide, N-methylpyrrolidone, ethylene carbonate, propylene carbonate, aqueous sodium rhodanide solutions and mixtures hereof and subsequent neutralisation of the multifilament yarn treated as described above and/or ii) by electron beam crosslinking of the meltable copolymers of polyacrylonitrile (PAN) and/or iii) by removing a plasticiser contained possibly in the meltable copolymer of polyacrylonitrile (PAN).

The previously mentioned first case of prestabilisation is thereby effected advantageously by guiding the non-prestabilised multifilament yarn through a modifying bath, comprising the mixture at a temperature of 20 to 80° C., preferably of 40 to 65° C., within a dwell time of 5 s to 2 min, preferably of 10 s to 60 s, or the non-prestabilised multifilament yarn is sprayed with the mixture.

Preferably, the aqueous alkaline solution comprises from 3 to 15 mol/l of at least one alkaline earth- or alkali salt, preferably an alkali hydroxide, particularly preferably potassium hydroxide or sodium hydroxide.

In the case where the method according to the invention is begun from a non-prestabilised multifilament yarn, a prestabilisation as described above is firstly effected. A neutralisation is hereby subsequently required, preferably the previously prestabilised multifilament yarn passing through a neutralisation bath (wash bath) which comprises an aqueous acidic solution with a pH value of less than 3, preferably less than 2, particularly preferably less than 1, and has temperatures of 5 to 95° C. and also a dwell time of 5 s to 2 min, preferably of 10 s to 60 s. The alkali hydroxides received in the modification bath of prestabilised multifilament yarn are thereby converted to form monovalent water-soluble salts and washed out.

Further advantageously, there can follow the thermal stabilisation, from which the thermally stabilised multifilament yarn results, a further temperature treatment under inert gas, in particular argon or nitrogen, at temperatures of 300 to 3,000° C., preferably at temperatures of 300 to 1,600° C., for the production of carbon fibres.

The invention relates in addition to a multifilament yarn which was produced by a method according to the invention as described previously.

Likewise, the present invention relates to a carbon fibre which was produced by further thermal treatment, in particular the previously described further temperature treatment, from the multifilament yarn according to the invention.

The present invention is explained subsequently in more detail with reference to the further more detailed embodiments and examples without restricting the present invention to the specially illustrated parameters.

As starting material, preferably a meltspun endless multifilament yarn made of PAN copolymers is used (PCT/EP2015/070769), which was converted into an unmeltable form according to the method described in PCT/EP2015/070771. This fibre material is subsequently termed "prestabilised PAN precursor".

The "prestabilised PAN precursor" is "thermally stabilised" by the method step according to the invention. By means of defined heat treatment and simultaneous stretching, the "prestabilised PAN precursor" is hereby converted into a state which is characterised preferably by non-flammability, black-colouration, fibre strengths of >50 MPa and fibre breaking elongations of >3% and also a stabilisation degree (DOS) of at least 30%. The stabilisation degree is defined by the proportion of nitrile groups (C═N) which have changed as a result of the heat treatment after the method step according to the invention ("ex-nitrile groups"), relative to the total number of nitrile groups in the starting material. The proportion of "ex-nitrile groups" is obtainable via solid-state NMR measurements, the proportion of unchanged nitrile groups (C═N) being determined and subtracted from the total number of nitrile groups.

In the method step according to the invention, the "prestabilised PAN precursor" is transported continuously through an oven open at both ends and heated in a defined manner, said oven being scoured with ambient atmosphere. By applying/producing a mechanical thread tension, sagging of the "prestabilised PAN precursor" is prevented and hence a high process stability is achieved. By applying oven temperatures in the range of 20 to 400° C. and exposure times at corresponding temperatures of 20 to 100 min, the "thermal stabilisation" is achieved. With increasing heat energy (temperature and time) to which the "prestabilised PAN precursor" is exposed, the stabilisation degree (DOS, Table 1) rises. With rising stabilisation degree, the mechanical fibre strengths drop however significantly (FIG. 1), so that at temperatures of >220° C., the "prestabilised PAN precursor" tears and hence a continuous fibre transport according to the method step according to the invention is no longer possible.

Surprisingly, by stretching (stretch-stabilisation, FIG. 1) of the "prestabilised PAN precursor" during the thermal treatment process, the fibre strength can be maintained so that, at temperatures >220° C., a continuous fibre transport is possible furthermore after the method step according to the invention and stabilisation degrees (DOS) of at least 30% are achieved. By means of stretch-stabilisation, stretching rates of 0 to 200% can be achieved.

FIG. 1 shows the mechanical strength of "thermally stabilised" fibres (according to the method according to the invention) as a function of the applied temperature, respectively with a stretching of the "prestabilised PAN precursor" of 0%, with 30% and with 100%, which was applied during this temperature application. Fibre strengths of at least 50 MPa are necessary in order to be able to achieve a continuous fibre transport and also winding up.

The "thermally stabilised" fibre materials (endless multifilament yarn) obtained according to the method according to the invention can then be treated, in a further thermal method step (precarbonisation), at temperatures between 300 and 1,000° C. and exposure times at corresponding temperatures of 10 to 100 min and can be converted into an "intermediate" carbon fibre (C proportion >80%).

The "intermediate" carbon fibres can then be subjected to a further thermal method step (carbonisation), the carbon proportion of the resulting fibre being increased to >90% by weight. For this purpose, the "intermediate" carbon fibres are transported continuously through a furnace and temperatures in the range of 1,000 to 2,000° C. and exposure times at corresponding temperatures of 5 to 60 min are applied.

Optionally, the thus obtained carbon fibre can also be graphitised at temperatures of 2,000 to 3,000° C.

Both carbonised and graphitised fibres can be activated physically or chemically on the surface by e.g. heat treatment in an oxidising atmosphere or plasma treatment or chemical treatment.

EXAMPLES 1-9

Figure 2:
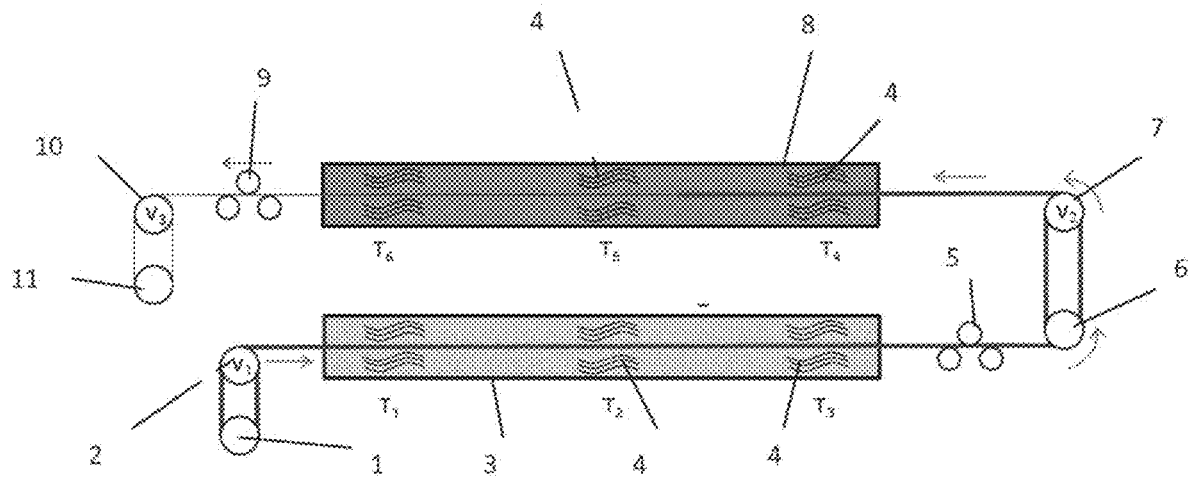
FIG. 2 illustrates the stretch-stabilisation method of the prestabilised PAN precursor in two pipe ovens in accordance with an embodiment of the invention.

The "prestabilised PAN precursor" is transported, by the method step according to the invention, corresponding to the below cited test arrangement, continuously through two pipe ovens (FIG. 2) which are scoured with ambient atmosphere. In the lower oven (3) by applying temperatures ($T_1$-$T_3$) in the range of 100 to 200° C. and exposure times at corresponding temperatures of 20 to 80 min, a stabilisation degree of >15% can be set in the fibre material. For example, a temperature gradient can be set in the lower oven (3) such that there applies, in the respectively separate zones of the oven: $T_1$=100° C., $T_2$=150° C. and $T_3$=200° C. After passing through the lower oven (3), the fibre material arrives at the upper oven (8) and likewise passes through the latter. In this thermal method step (stretch-stabilisation), the fibre material is treated at temperatures ($T_4$-$T_6$) between 150 and 350° C. and exposure times at corresponding temperatures of 5 to 80 min. As a result of the speed ratio of the fibre transport devices ($v_3/v_2$), the fibres were stretched by 0%, 30% or 100% (Table 1). Only by stretching the fibres during the temperature exposure, can the entire process be conducted continuously and maintained according to FIG. 2. The result is a "thermally stabilised" fibre which is characterised by non-flammability, black colouration, fibre strengths of >50 MPa and fibre breaking elongations of >3% and also a stabilisation degree (DOS) of at least 30%.

Device with which a Thermally Stabilised Multifilament Yarn According to the Present Invention can be Produced A prestabilised multifilament yarn is thereby wound off a roll (1) and introduced into a first oven (3) by means of a galette (2) running at a speed $v_1$. The oven is thereby flowed through by air and is subdivided into three temperature zones ($T_1$, $T_2$, $T_3$). In temperature zone $T_1$, for example a temperature of approx. 100° C. can be set. The temperature in temperature zone $T_2$ can be for example approx. 150° C., the temperature of temperature zone $T_3$ for example approx. 200° C. The separate temperature-control in the individual zones of the oven (3) can thereby be effected by means of separate heating elements (4) provided in the respective zones. The wound-off thread is transported continuously through the oven. By means of a tension-measuring sensor (5), the tension applied to the multifilament yarn can be determined. The multifilament yarn exiting from the lower oven (3) is deflected by means of further galettes (6) and (7) and supplied to a second oven. In the case, illustrated in FIG. 2 by way of example, the speed at which the galettes (2) and (6) run can be the same so that there applies: $v_1$=$v_2$. By means of the galette (7), the multifilament yarn is supplied to the upper oven (8) which is likewise flowed through by air. Also this further oven (8) is subdivided into three temperature zones $T_4$, $T_5$ and $T_6$, the temperatures of temperature zone $T_4$ can be approx. 150° C., of temperature zone $T_5$ approx. 200° C. and in temperature zone $T_6$ approx. 250° C. Also in the oven (8), separate heating elements (4) are present which enable separate temperature-control of the zones. After exit of the now thermally stabilised multifilament yarn, a further tension measurement by means of the tension sensor (9) can be effected. The thermally stabilised multifilament yarn is thereby drawn off by means of the galette (10) which runs at a speed $v_3$. The speed $v_3$ is thereby greater than the speed $v_2$ of the galette (7) so that stretching of the multifilament yarn is undertaken at least in the upper oven. The finally thermally stabilised multifilament yarn is finally wound onto a roll (11).

TABLE 1

Characteristics of the fibres "thermally stabilised" according to the method according to the invention. Fibres which were not stretched during the heat treatment (0%) cannot be transported continuously.

| | Fibre transport speed | | | Continuous fibre | | |
|---|---|---|---|---|---|---|
| Temperature $T_4$-$T_6$ in [° C.] | $V_2$ in [m/h] | $V_3$ in [m/h] | Stretching [%] | transport possible | Strength [MPa] | DOS [%] |
| 230 | 2.0 | 2.0 | 0 | No | 10 | ~30 |
| | 2.0 | 2.6 | 30 | Yes | 125 | ~30 |
| | 2.0 | 4.0 | 100 | Yes | 175 | ~30 |
| 240 | 2.0 | 2.0 | 0 | No | 10 | ~45 |
| | 2.0 | 2.6 | 30 | Yes | 60 | ~45 |
| | 2.0 | 4.0 | 100 | Yes | 175 | ~45 |
| 250 | 2.0 | 2.0 | 0 | No | 10 | ~50 |
| | 2.0 | 4.0 | 100 | Yes | 175 | ~50 |

DOS: stabilisation degree

The invention claimed is:

1. A continuous method for the production of a thermally stabilised multifilament yarn made of a meltable copolymer of polyacrylonitrile (PAN), in which a prestabilised multifilament yarn or a non-prestabilised multifilament yarn is fed continuously, in the case of a non-prestabilised multifilament yarn, a prestabilisation and subsequently a neutralisation are implemented, and subsequently the prestabilised multifilament yarn is thermally stabilised at a temperature greater than 0° C., wherein the thermal stabilisation is implemented by feeding the multi-filament yarn through at least two ovens which are connected subsequently, in at least a first oven, no stretching or stretching <10% and, in at least one further oven, stretching of at least 30% is effected, in the at least a first oven, temperatures of 80 to 200° C. being set, and, in the at least one further oven, temperatures of 130 to 270° C. being set, and stretching of the multifilament yarn is implemented, at least at times, during, before and/or after the thermal stabilisation.

2. The method according to claim 1, wherein the strength of the thermally stabilised multifilament yarn standardised to the filament diameter is at least 50 MPa.

3. The method according to claim 1, wherein the multifilament yarn is stretched by 10 to 300%.

4. The method according to claim 1, wherein the thermal stabilisation is effected by feeding the multifilament yarn through at least one oven or at least two ovens connected subsequently.

5. The method according to claim 1, wherein the thermal stabilisation is implemented in two stages, the multifilament yarn not being stretched or to a lower degree in the first stage than in the second stage and/or being stabilised, in the first stage, at lower temperatures on average than in the second stage.

6. The method according to claim 1, wherein the thermal stabilisation is implemented with rising or constant temperatures in the feeding direction of the multifilament yarn.

7. The method according to claim 1, wherein the thermal stabilisation is implemented such that a stabilisation degree (DOS) of the copolymer of polyacrylonitrile of 20 to 75% results.

8. The method according to claim 1, wherein the thermal stabilisation is implemented in an oxidising atmosphere.

9. The method according to claim 1, wherein the thermal stabilisation is effected with application of tensile stress to the multifilament.

10. The method according to claim 1, wherein the thermal stabilisation is implemented over a period of 10 to 180 min.

11. The method according to claim 1, wherein the copolymer of polyacrylonitrile (PAN) is produced by copolymerisation of 99.9 to 70% by mol of acrylonitrile with at least one comonomer selected from a) 0.1 to 20% by mol of at least one alkoxyalkylacrylate of the general formula I, Formula I

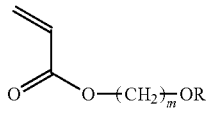

with R=$C_nH_{2n+1}$ and n=1-8 and m=1-8, b) 0 to 10% by mol of at least one alkylacrylate of the general formula II Formula II

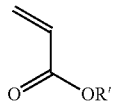

with R'=$C_nH_{2n+1}$ and n=1-18, and c) 0 to 10% by mol of at least one vinyl ester of the general formula III Formula III

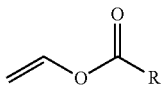

with R=$C_nH_{2n+1}$ and n=1-18.

12. The method according to claim 1, wherein the multifilament yarn is produced by melting and extrusion of the copolymer of polyacrylonitrile through at least one spinning nozzle and spinning to form multifilaments.

13. The method according to claim 1, wherein the prestabilisation of the non-prestabilised multifilament yarn is implemented i) by treatment with a mixture comprising at least one solvent for polyacrylonitrile and an aqueous alkaline solution or consisting thereof, and subsequent neutralisation of the treated multifilament yarn, and/or ii) by electron beam crosslinking of the meltable copolymers of polyacrylonitrile (PAN), and/or iii) by removing any residual plasticiser contained in the meltable copolymer of polyacrylonitrile (PAN).

14. The method according to claim 13, wherein the prestabilisation is effected by guiding the non-prestabilised multifilament yarn through a modifying bath, comprising the mixture at a temperature of 20 to 80° C., within a dwell time of 5 s to 2 min, or the non-prestabilised multifilament yarn is sprayed with the mixture.

15. The method according to claim 13, wherein the aqueous alkaline solution comprises from 3 to 15 mol/l of at least one alkaline earth- or alkali salt.

16. The method according to claim 1, wherein the neutralisation is effected by guiding the prestabilised multifilament yarn through a neutralisation bath, comprising an aqueous acidic solution with a pH value of less than 3, and at a temperature of 5 to 95° C., within a dwell time of 5 s to 2 min.

17. The method according to claim 1, wherein a further temperature treatment under inert gas, at temperatures of 300 to 3,000° C., follows the thermal stabilisation, resulting in the production of a carbon fibre.

* * * * *